US005145429A

United States Patent [19]

Stoddart et al.

[11] Patent Number: 5,145,429

[45] Date of Patent: Sep. 8, 1992

[54] FLUID AND MATERIAL TRANSFER AT SEA

[75] Inventors: John S. Stoddart, Horsham; William E. Abraham, Hindhead, both of Great Britain

[73] Assignee: Foster Wheeler Energy Limited, Reading, United Kingdom

[21] Appl. No.: 517,008

[22] Filed: May 1, 1990

[30] Foreign Application Priority Data

May 2, 1989 [GB] United Kingdom ..... 8909994

[51] Int. Cl.[5] ..... B67D 5/68

[52] U.S. Cl. ..... 441/4

[58] Field of Search ..... 114/230, 258, 321, 253, 114/254; 441/1, 3, 4, 5; 137/615; 141/279, 382, 383, 387

[56] References Cited

U.S. PATENT DOCUMENTS

| | | | |
|---|---|---|---|
| 3,100,006 | 8/1963 | Sheets et al. . | |
| 3,464,466 | 9/1969 | Bryan . | |
| 3,507,241 | 4/1970 | Southerland et al. . | |
| 3,536,023 | 10/1970 | Toher et al. . | |
| 3,863,590 | 2/1975 | Karl et al. . | |
| 3,993,011 | 11/1976 | Garland . | |
| 4,064,820 | 2/1977 | Vogt . | |
| 4,273,066 | 6/1981 | Anderson | 441/5 |
| 4,286,896 | 9/1981 | Melitz et al. | 114/258 |
| 4,459,930 | 7/1984 | Flory | 441/5 |
| 4,516,517 | 5/1985 | Ayers | 114/253 |
| 4,643,462 | 2/1987 | Wallace | 441/4 |
| 4,741,716 | 5/1988 | Hasebe et al. | 441/4 |
| 4,867,211 | 9/1989 | Dodge et al. | 441/4 |

FOREIGN PATENT DOCUMENTS

| | | |
|---|---|---|
| 1555926 | 12/1968 | France . |
| 8203101 | 3/1984 | Netherlands . |

*Primary Examiner*—Jesus D. Sotelo
*Assistant Examiner*—Stephen P. Avila
*Attorney, Agent, or Firm*—Marvin A. Naigur

[57] ABSTRACT

A system for receiving and securing an object at sea comprises a framework installed on a ship and having a track. A cradle is mounted on the track for movement between two positions of which one is substantially at or below the water line of the ship. The cradle includes guides for directing the object into the cradle and a locking mechanism for securing the object therein. Means are also provided for moving the cradle between the two positions on the track. In a variant of the invention, the system can be adapted for use in receiving and securing an object in a marine environment on a receptor body more generally. Such system comprises a target mounted on the body and having guides for directing the objection into the target, and a winding mechanism with a line associated therewith. The line is attachable to the object and extends between the guides of the target. The mechanism is operable to wind in the line through the guides to draw the object into the target between the guides.

33 Claims, 5 Drawing Sheets

FLUID AND MATERIAL TRANSFER AT SEA

FIELD OF THE INVENTION

This invention relates to marine activity, particularly offshore. Broadly, it relates to the movement of objects to, from and between bodies in, on or adjacent to water. A particular application of the invention is the securing of some form of connection between two vessels, or between a vessel and a stationary structure, to enable the transmission of material therebetween. Such material may be particulate or liquid matter, or a mixture of both, but the connection could similarly be used for the transmission of information.

BACKGROUND TO AND SUMMARY OF THE INVENTION

In offshore activity, there is frequently a need to transfer liquid from a reservoir ship to a more mobile tanker for the carriage of the liquid to an onshore site. In oil production for example, oil pumped from a subsea well is normally delivered to such a floating reservoir from which tankers are loaded. Heretofore, the connection between the reservoir and the tanker has been accomplished by dragging the end of a hose from the reservoir directly to a coupling or union on the tanker deck. During part of its journey, the end of the hose will usually be freely suspended over the surface of the water, and particularly in adverse weather conditions, the operation can be extremely hazardous.

In accordance with the present invention, the movement of an object to a target is carried out substantially at or below the water surface. This is accomplished by the positioning of a target in the form of a cradle mounted substantially at or below the surface level of the water, and guiding the object into the cradle. The object is then secured in the cradle for further action as appropriate. Normally, the object will be drawn into the cradle by means of a line attached at one end to the object and at the other end to a winching mechanism. The line will pass through the cradle between guides disposed thereon specifically to locate the object as it is received therein, and in this way a positive location or docking of the object is achieved. However, for some applications of the invention the object may be free in the water, and have its own motive power and guidance mechanism directed towards and into the cradle. The cradle itself might have means for transmitting a homing signal to the object for this purpose.

As noted above, in order to receive the object, the target, which may conveniently be a cradle, as has been already stated, is disposed substantially at or below sea level. For some applications, the cradle may be fixed on its supporting body in a sealed compartment with doors openable to the sea to provide access for the incoming object. In one alternative, the cradle may be mounted on a track which is extendable from the compartment into the water so that the cradle can be moved to a position external to the supporting body to receive the object, and then retrieved with the object into the compartment. The track may be formed on a moveable frame for this purpose. It is of course also possible to have the cradle mounted externally of the body.

In this variation the cradle is movable on a track between two positions and has the track extending from a receiving position substantially at or below sea level, to another position above sea level, for example the deck of a ship. The track may be mounted directly in the side of the body or ship, or on a framework attached thereto. Such a framework may itself be moveable between an operative position on the side of the body and a storage position when it is not in use.

Where the invention is used with a line for drawing the object into the cradle, the line (in fact a pilot or messenger line) is dispatched from the receiver body or ship to the sender body for attachment to for example, the end of a hose. If the line is not already passing into and through the cradle to a winch, it is so threaded or attached to a draw line which is already in place, and the winch then activated to draw the hose end from the sender body into the cradle. If the hose end is initially above sea level, then it first falls into the sea but is then drawn substantially horizontally at or below sea level to the cradle. Normally, the buoyancy of the hose, and the hose end in particular, will be such that it is maintained at or just below the surface level of the water. In some cases, the hose end may be supported from surface buoys to ensure that the hose end does not sink, and thus impose excessive demands on the winch mechanism. By substantially establishing the path of the hose end in this way, the orientation of the cradle may be substantially fixed, and guides thereon adapted to effect the necessary alignment at final approach. It will be appreciated that the hose end supported at or just below the water surface, even in rough seas, is much less subject to unpredictable movement than it would be if freely suspended above the surface, either from a floating vessel or even from a stationary structure. Even so, some flexibility in the guides in the cradle is desirable and they could be resiliently mounted. Guides within the cradle also define a convergent entrance to the cradle. Guides external to the cradle may also be used to effect initial entry.

When the object such as a hose end is received in a cradle provision will be made for securing it therein either at a fixed orientation or, and particularly if the cradle is then to be moved, in a manner which permits the object to pivot. To this end, the cradle may be particularly adapted to receive objects with trunnions thereon, and be provided with guides in the form of slots for receiving the trunnions. Upon the object being fully received in the cradle, claws may close around the trunnions which permit pivotable movement of the object about the axis of the trunnions. Thus, where the cradle is mounted externally of the receiving body and adapted to be raised above sea level the object is suspended on its trunnions which enable it to pivot freely until the cradle reaches its onboard position.

As described above, the invention is particularly useful in the offshore industry where connections must be made between floating vessels for the transfer of liquids or gases therebetween. Such fluids include not only hydrocarbon fuels, but also water, drill mud and other substances which are capable of flowing as required. Where a connection is to be made to an underwater vessel such as a submarine, air and fresh water can be transferred in this way, and waste matter can be removed. Connections made according to the invention can also be used to transmit data and information along a cable or through a hose. Where the object received in the cradle is otherwise free in the body of water, it may be used as a transfer vehicle for solid matter, materials and equipment that cannot be moved along a duct or hose.

The cradles used in connection or transfer systems of the invention may take the form of tubes oriented substantially horizontally to receive the object which may conveniently be a hose end. A similar system to that used to connect multi-bore hoses to a well head on the sea bed can be adopted. Torpedo tubes can also be adapted to receive objects in systems embodying the invention, either drawn into the tube by a line or directed thereto by other means.

Where the invention is used to connect a hose or other conduits, once the hose end is safely received in the cradle, it can be coupled to a union of the receiving body using known coupling techniques, for example of the type used in the oil industry. Suitable transfer hoses are also available, although some adaptation may be necessary to connect a draw line to the end thereof and provide for safe guidance into the cradle. Conveniently, systems according to the invention may use a separate head unit which couples to the hose end using the fittings already available on the hose end, the head unit having been specially adapted to a particular cradle design. In this variant, once the head and the hose end are both safely received in the cradle, the head can be removed and the hose end coupled to a union on the receiving body in known manner.

Some embodiments of the invention will now be described by way of example and with reference to the accompanying schematic drawings wherein:

DESCRIPTION OF PREFERRED EMBODIMENTS

Figure 1:
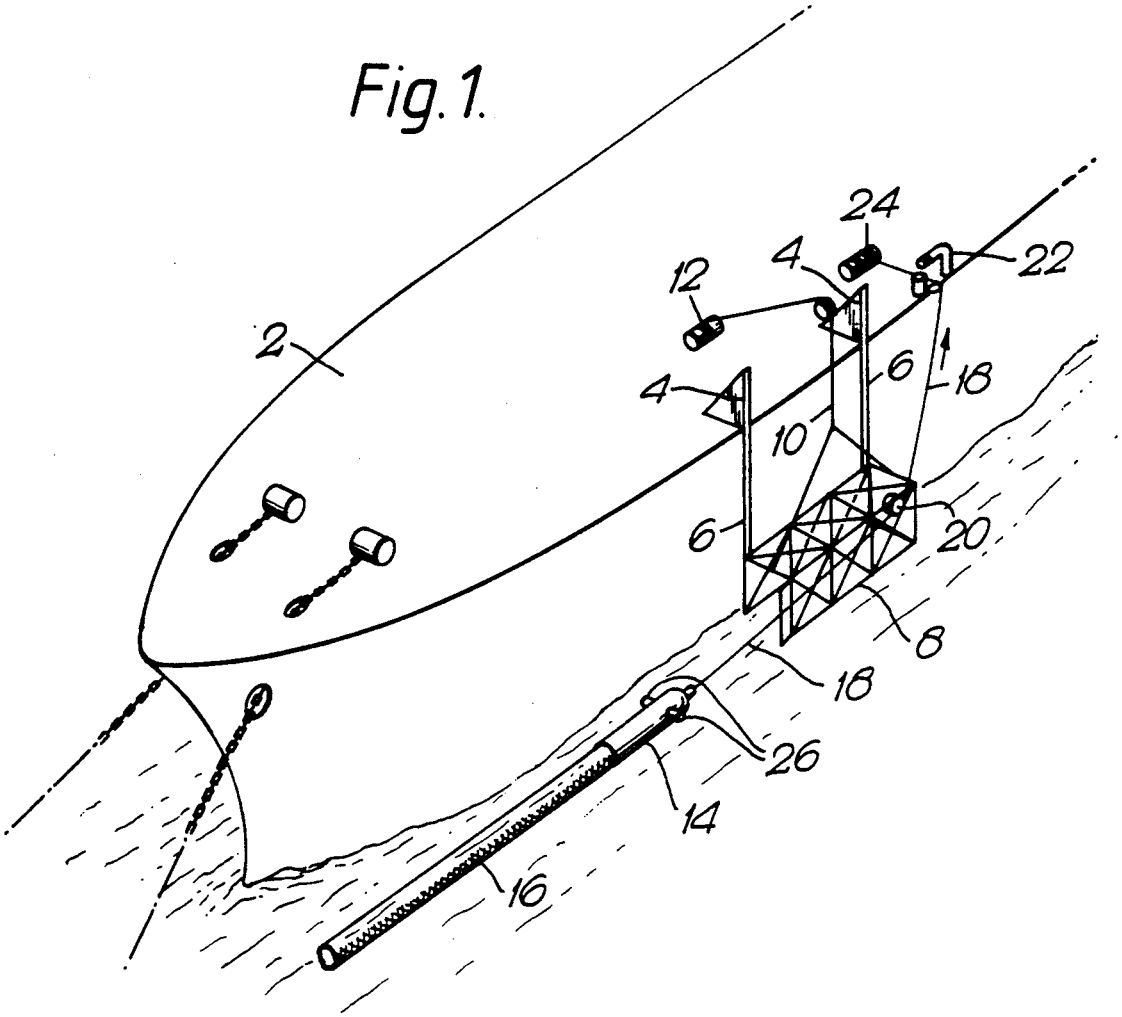
FIG. 1 is a perspective outline view of a ship fitted with a system according to the invention as a hose end is drawn towards it.

FIG. 1 shows a ship's hull 2 with a framework 4 mounted on the side thereof comprising vertically extending rails 6. Mounted on the rails 6 and able to slide along them is a cradle 8 suspended on a cable 10 extending from a lifting winch 12. Operation of the winch 12 raises and lowers the cradle 8 as required. Releasable locking mechanisms (not shown) are fitted to either the rails 6 or the cradle 8 to secure the cradle respectively at its upper and lower positions on the frame 4.

Shown approaching the cradle 8 (in FIG. 1) is the end 14 of a hose 16. Attached to the end 14 is a draw line 18 which extends around a pulley 20 in the cradle and upwards through a fairlead 22 to a second winch 24. Thus, as the line 18 is drawn in by operation of the winch 24, the hose end 14 is drawn into the cradle. Once it is safely received in the cradle, the hose end is secured by means of trunnions 26 which allow pivotable movement.

Figure 2:
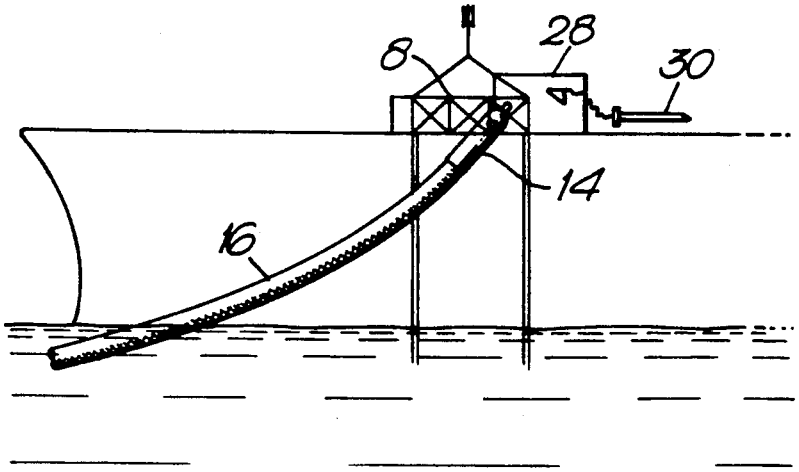
FIG. 2 is a side view of the ship of FIG. 1 showing the hose end raised to its coupling position.

With the hose end 14 secured in the cradle, the winch 12 is activated to raise the cradle on the rails 6 to the position shown in FIG. 2. At this point, the hose end may be coupled by conventional means to one or more unions on the ship deck at coupling station 28 which are themselves connected to the fixed piping 30 of the ship. Once coupled, fluid material may be transferred to and from the ship along the hose 16 in the usual way.

Figure 3:
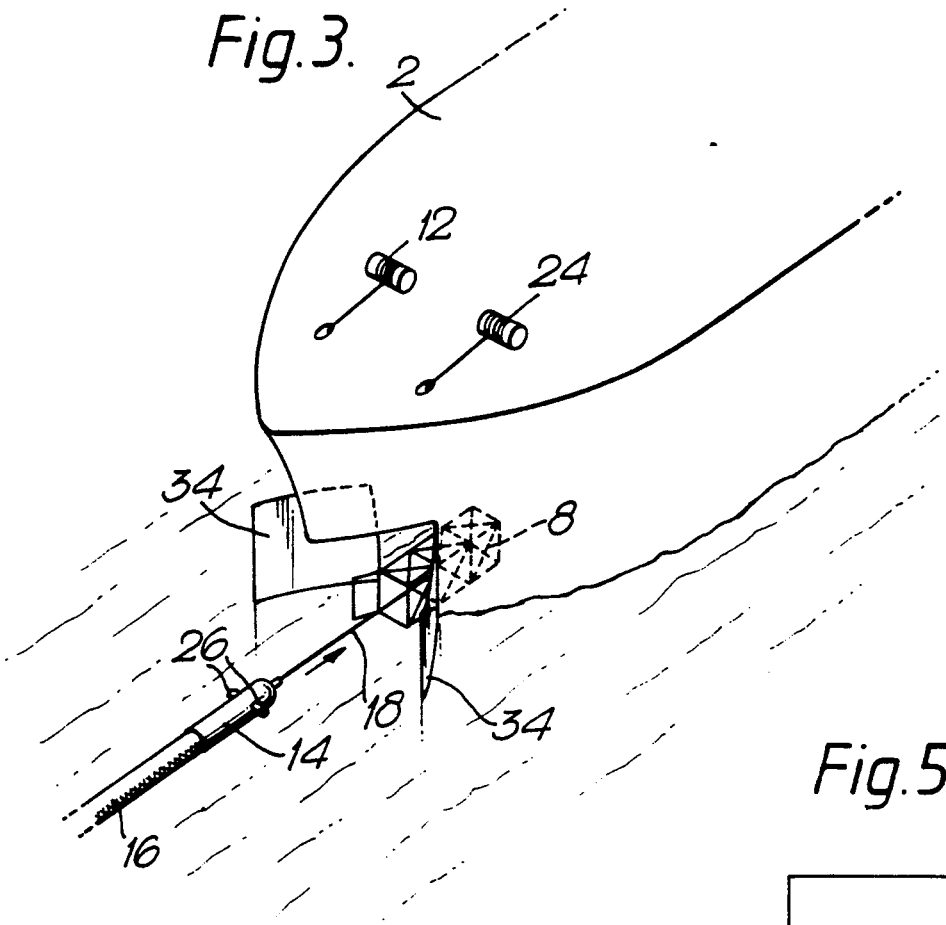
FIG. 3 shows in perspective outline view the bow of a ship with a forward compartment adapted to receive a hose end.
Figure 4:
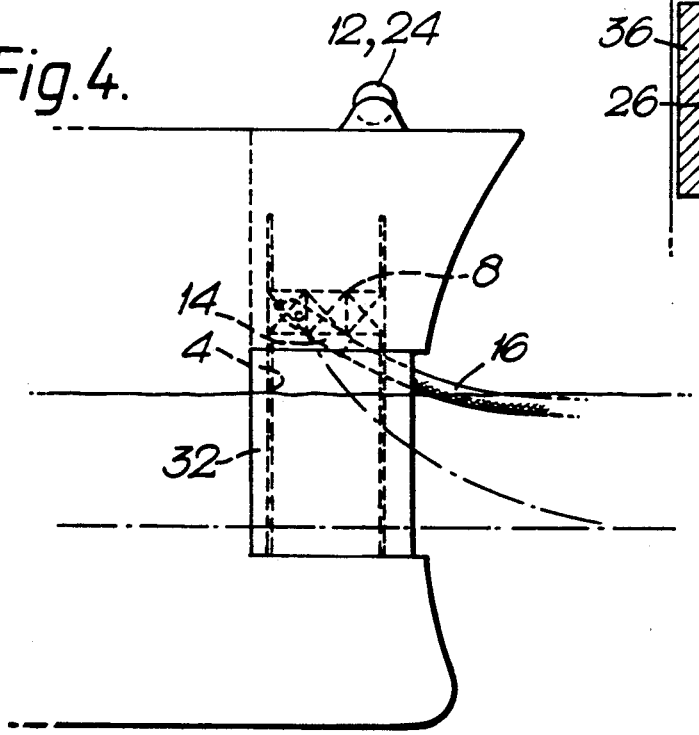
FIG. 4 is a side view of the ship bow shown in FIG. 3 illustrating the raising of the hose end to its coupling position.

FIGS. 3 and 4 illustrate a system which operates in substantially the same way as that of Figure 1, and where appropriate the same reference numerals are used. The essential difference is that the frame 4 and the cradle 8 are mounted inboard of the ship in a bow compartment 32. Access to the bulkhead is obtained by means of bow doors 34. Once the doors 34 are opened, the hose end 14 can be drawn into the cradle 8 and raised to the coupling position, also within the ship, in substantially the same manner as described above with reference to FIGS. 1 and 2. In this case though, the coupling station and connections to the ship's fixed piping will be inboard and below deck.

In using either of the systems of FIGS. 1 to 4, provision must be made for making the initial connection between the draw line 18 and the hose end 14. Normally, a pilot line will be first dispatched from the ship 2 to the sender vessel or station, which is then used to extend the draw line 18 to the sender station where it is connected by a suitable coupling to the hose end 14. However, the pilot line could of course be dispatched from the sender station, and other techniques are readily available. For example, mechanical fish can be used to carry pilot and/or draw lines between sender stations and receiver ships.

Figure 5:
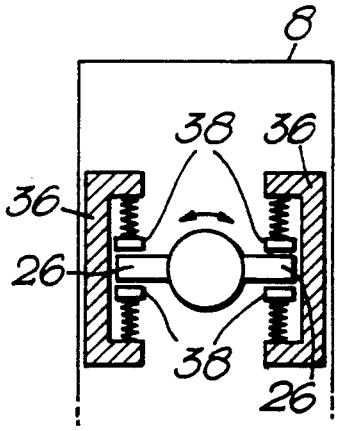
FIG. 5 illustrates one possible guidance mechanism in the cradle for an incoming hose end.

As the hose end 14 approaches the cradle 8, it must be aligned therewith both to ensure the proper orientation of the trunnions 26, and possibly to ensure proper orientation of couplings in the hose end for connection to the unions at the station 28. As shown in FIG. 5, the trunnions 26 of the hose end 14 are respectively received in trunnion guides 36 which are themselves mounted within the cradle 8. The guides 36 include spring mounted guide plates 38 which serve to stabilise the hose end 14 whilst allowing some torsional flexibility as it moves towards its secured position.

Figure 6:
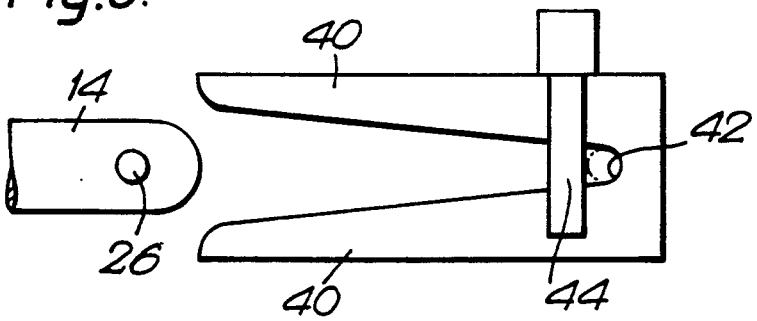
FIGS. 6 to 9 show three alternative guidance and locking mechanisms in the cradle.
Figure 7:
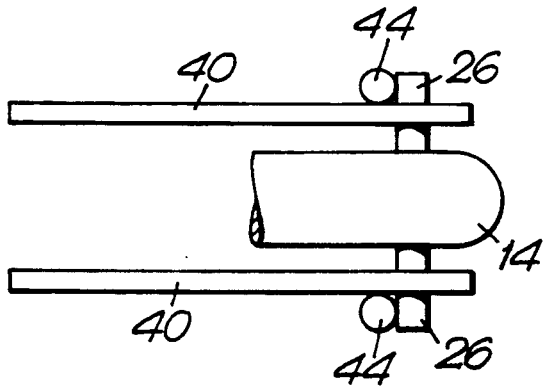

Some mechanisms for securing the hose end 14 in the cradle are shown in FIGS. 6 to 9. In FIG. 6, the trunnion guides form a pair of jaws 40 adapted to receive each trunnion 26. The jaws 40 converge so as to guide the trunnions to a docked position against surfaces 42 on either side of the cradle. Pins 44 are then dropped through corresponding holes in the jaws to lock the trunnions against the surface 42. FIG. 7 shows in plan view the hose end 14 so secured in the cradle, and it will be appreciated that in this position the hose end 14 can pivot relatively freely in a vertical plane and therefore adapt to the vertical movement of the cradle illustrated in FIGS. 1 to 4.

Figure 8:
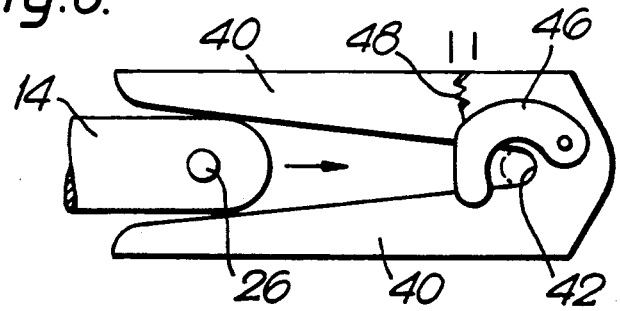
Figure 9:
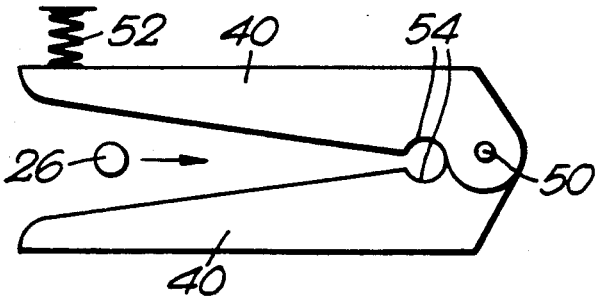

FIG. 8 illustrates an alternative locking system in which the pins 44 are replaced by an overcentre clamp 46 normally held in the open position by means of a pawl 48 which is released by the impact of the trunnions 26 on the surface 42. FIG. 9 shows another alternative where the jaws are themselves pivoted about an axis 50 with the upper jaw being resiliently urged towards the lower by a spring 52 or other suitable mechanism. The profile of each jaw 40 is adapted to form a recess near the crotch of the jaws such that the approach of the trunnions 26 first forces the jaws apart, and then allows them to close around the trunnions to lock them in place.

A cradle 8 suitable for use in the embodiments thus far described will normally be a box shaped structure with an open base to allow for the pivotable movement of the trailing hose 16. Various mechanisms may be used for guiding the hose end into the cradle and for securing it in the locked position, and those described above are given by way of example only. Further, if desired a separate head can be provided for attachment to the hose end, which head is specifically adapted to be received in a particular cradle design. Indeed, such a head can be part of the system associated with the cradle, and be adapted to be transmitted from a ship to a sender station for attachment to the hose end.

The use of a separate head has a number of advantages. It may be designed to lock over the hose end to seal the ends of one or more conduits therein, thus obviating the need for separate closures. It may also be adapted for attachment to a pilot line connection or a mechanical fish for transference to the sender station or vessel. In either case, the same locking mechanism may be used for both attachments.

Figure 10:
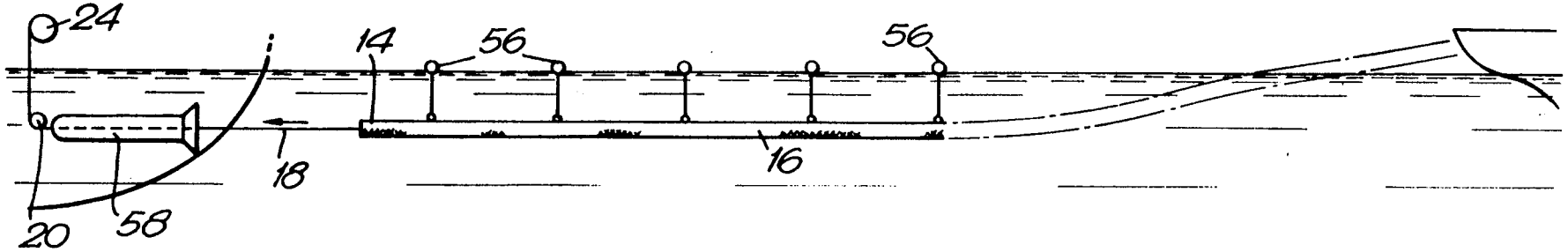
FIGS. 10 and 11 show the use of a variant of the invention in which the receiving cradle is fixed in the receiving body.
Figure 11:
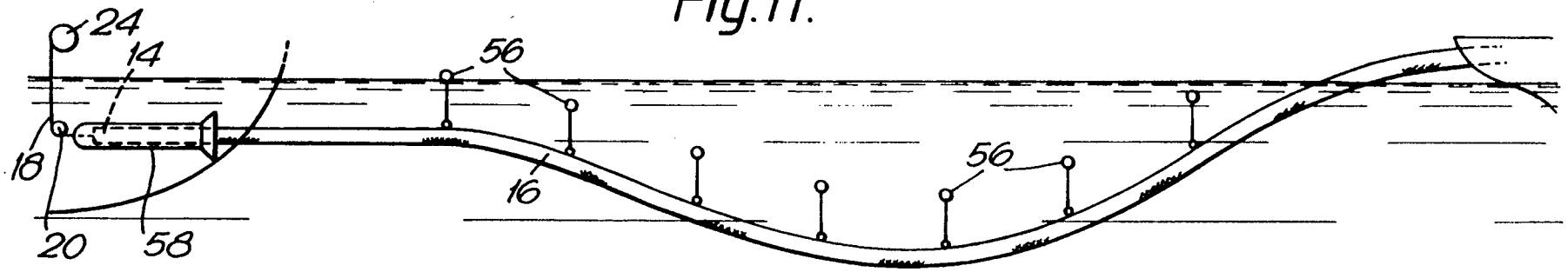
Figure 12:
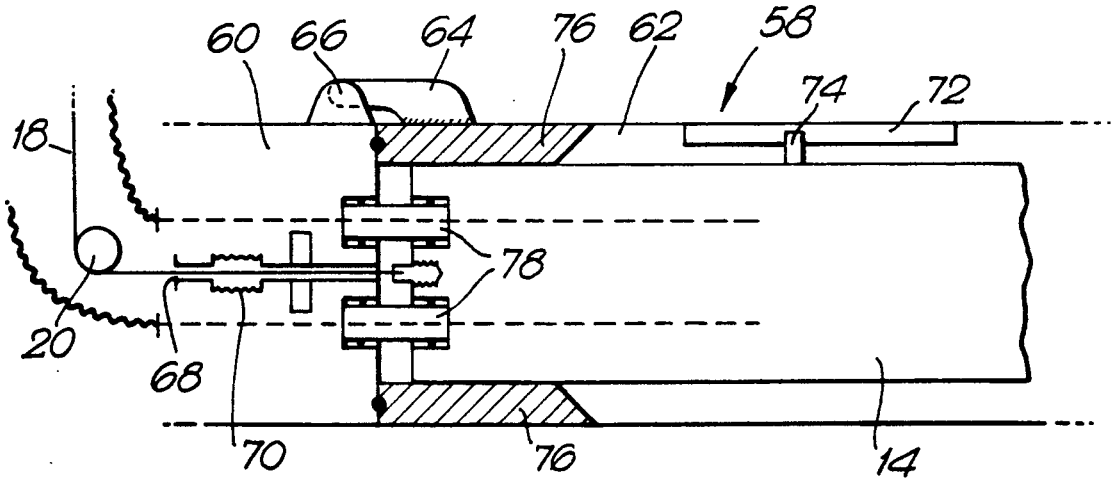
FIG. 12 shows in partial sectional elevation a receiving cradle of the type used in FIGS. 10 and 11.

FIGS. 10 to 12 illustrate an embodiment of the invention in which the cradle is fixed in the receiver body or ship. FIGS. 10 and 11 also show how a hose 16 can be suspended below the water surface as it is drawn into the cradle. As shown in FIG. 10, the hose is suspended from surface buoys 56, typically at a depth of one to three meters. In this way, the hose is less subject to violent movements of the water at surface level, and is more readily aligned with the cradle for docking. FIG. 11 shows hose 16 with its end 14 docked, and illustrates how the hose remains suspended below the surface of the water even when fluid material is being transferred through it. The buoys 56, which may now be submerged because of the increased weight of the hose, still serve to stabilise its position.

In FIGS. 10 and 11, the cradle takes the form of a tube 58 mounted in the hull of a ship 2 below the Plimsoll line or normal water level. The docking procedure is broadly similar to that described with reference to FIGS. 1 and 2, although alignment of the approaching hose end 14 may be more critical. The design of the tube 58 is shown in more detail in FIG. 12.

The tube 58 shown in FIG. 12 is broadly similar to a torpedo tube, and has an inner door 60 secured by a conventional breech lock ring. The tube body 62 is fixed, and the door 60 attached thereto by means of a bracket(s) 64 with a hinge(s) 66. In this embodiment the pulley 20 is mounted on the door 60 such that the draw line 18 is properly aligned with a passage 68 passing actually through the door and into the tube body 62. The passage 68 can have a seal gland 70 to enable the total coupling of the hose to the ship fixed piping to be effected at least semi-automatically upon the hose end 14 being fully received in the tube body 62.

To align the hose end 14 properly in the tube 62, an orientation bushing 72 is mounted on the body 62, and receives a spigot 74 as the hose end 14 makes its final approach. Near the closed end of the tube 62 is provided a collet connector which accurately centres the hose end. (If the hose is single bore only, an orientation bushing would not be required.)

In the embodiment illustrated in FIG. 12, the hose is of the multi-bore type, and connectors 78 are provided for connecting each bore to corresponding bores in the door 60. These connectors can be of the quick release type enabling the connections to be made substantially automatically as the hose end is hauled by the line 18 into its docked position in the tube body 62.

In all embodiments of the invention in which the object or as illustrated, the hose end, is drawn into the cradle by a line, provision is normally made for detaching the line from the object once it has been secured. This facilitates the making of connections to fixed piping and of course enables a hose to be hauled from the cradle after the exercise for which it has been connected has been completed, and the connections broken. Most simply, this detachment is accomplished by cutting the line, and the cradle can include a cutting mechanism for this purpose. If as described above, a separate head has been used, this may be removed. The line might also be detachably coupled to the hose end by any suitable mechanism.

The illustrated embodiments of the invention have been described in the context of offshore transmission to or between floating vessels, and the benefits of the invention in these Applications will be readily apparent. However, it will be equally apparent that the invention can be usefully exploited in making connections and communications to and between vessels wholly below the water surface, and from or to fixed structures on land or anchored to the sea bed. Similarly, it will be recognised that the use of the draw line 18 can be dispensed with if the hose end can be forced through the water and into the cradle by some other means, and such alternatives might be particularly valuable where a transfer vehicle; for example a vehicle not connected to a hose or other trailing component is to be received and docked. A transfer vehicle might even be adapted to hold its approach some distance from the cradle, and receive or dispatch a line which can be used to enable it to be drawn into the cradle to complete the transfer. Further, although the invention is described herein primarily in the context of a single object or hose, it will be appreciated that it is equally applicable to multiple objects and hoses in bundles or arrays, as are common in the field of connections between marine sites.

In case of an underwater transfer it may be convenient with a suitably designed hose to keep such hose under tension. In these circumstances one vessel can transfer to the other whilst towing or being towed by that other, thereby achieving transfer in a towed system.

We claim:

1. A system for receiving and securing an object an sea, the object being an end of a hose, the system comprising:

a framework installed on a ship and having a track;

a cradle mounted on the track for movement between two positions thereon, of which one position is a position for receiving an end of a hose and is substantially at or below the water line of the ship, the cradle including guides for directing a said object in the form of an end of a hose while the object is within the cradle;

a locking mechanism for securing a said object in the cradle; and means for moving the cradle between said two positions on the track.

2. A system according to claim 1 wherein the one position is located in a sealed bulkhead within the ship to the sea when the cradle is in the said one position.

3. A system according to claim 1 wherein the framework is installed in a sealed bulkhead having doors openable to expose the bulkhead to the sea, the cradle being movable on the track to its said one position external of the ship.

4. A system according to claim 1 wherein the framework is mounted with the track in the ship side, the cradle being movable on the track adjacent the ship to and from its said one position.

5. A system according to claim 1 wherein the framework is mounted externally of the ship.

6. A system according to claim 5 wherein the framework is itself movable relative to the ship between an operative disposition at which the cradle can move to and from its said one position, and a storage disposition.

7. A system according to claim 1 wherein the cradle comprises jaws for receiving a said object, the jaws being movable towards each other to clamp and secure a said object therebetween.

8. A system according to claim 7 wherein the locking mechanism is operative in response to the arrival of a said object to close the jaws.

9. A system according to claim 8 wherein the locking mechanism is disposed at the crotch of the jaws.

10. A system according to claim 1 wherein the guides comprise rollers at an end of the cradle.

11. A system according to claim 1 wherein the guides comprise slots for receiving trunnions on a said object to align a said object relative to the locking mechanism.

12. A system according to claim 1 wherein the cradle includes a device for transmitting a homing signal for use in directing a said object to the cradle.

13. A system for receiving and securing an object in the form of an end of a hose in a marine environment on a receptor body, comprising a target mounted on the body and having guides for directing a said hose end while in the target; and a winding mechanism with a line associated therewith, the line being attachable to a said hose end at a location remote from the receptor body and extending between the guides of the target, and the mechanism being operable to wind in the line through the guides to draw a said hose end into the target between the guides.

14. A system according to claim 13 including means for retaining a said object in the target after being drawn thereinto.

15. A system according to claim 14 wherein the target includes a quick release mechanism operable to free a said object from the retaining means in the target.

16. A system according to claim 13 wherein the receptor body is a floating vessel.

17. A system according to claim 13 wherein the target is fixedly mounted in the receptor body.

18. A system according to claim 13 wherein the target is a cradle mounted for movement between first and second positions, the first position being for receiving a said object, and the second position being spaced therefrom on the body.

19. A system according to claim 18 wherein said first position is external of the body, and said second position is within the body.

20. A system according to claim 18 wherein said first position is within the body, and wherein the body has doors in the side thereof for selectively exposing the cradle to said environment.

21. A system according to claim 18 wherein both said first and second positions are external of the body.

22. A system according to claim 18 wherein the cradle is mounted on a track, and movable thereon between said first and second positions.

23. A system according to claim 22 wherein the track is itself movably mounted on the body.

24. A system according to claim 21 wherein the track is selectively securable at the side of the receptor body, and movable to a storage position on the body.

25. A system according to claim 13 wherein the guides comprise jaws for receiving a said object therebetween.

26. A system according to claim 13 wherein the guides comprise slots for receiving trunnions on a said object as it is drawn into the target.

27. A system according to claim 26 wherein the walls of the slots are resiliently mounted in the target.

28. A method of connecting one end of a hose, of which an other end is coupled to a sender station, across open sea to a union on a receptor body, the method comprising:

providing a target mounted on the receptor body and having guides;

providing a winding mechanism having a line attachable to the said one hose end;

extending the line between the guides of the target and across open sea to a location remote from the receptor body;

attaching the line to the said one end of the hose at said remote location;

winding the line through the guides, thereby drawing the said one hose end across open sea;

drawing the said open hose end into the target and into contact with the guides; and connecting the said one hose end to the union.

29. A method according to claim 28, wherein the target is a cradle mounted for movement between first and second positions, the first position being for receiving a said hose end, and the second position being spaced therefrom on the body including the step of moving the cradle on the receptor body including the step of moving the cradle on the receptor body with the hose therein from said first to said second position; and connecting the hose to the union at the second position.

30. A method according to claim 29 wherein the cradle is mounted on a track, and movable thereon between said first and second positions including the step of moving and securing the track at the side of the receptor body, and moving the cradle on the track to its said first position thereon before drawing the hose end into the cradle.

31. A method according to claim 28 wherein the target is located substantially at sea level when the hose end is drawn thereinto.

32. A method according to claim 28 wherein the hose end is maintained substantially at sea level as it is drawn towards the target.

33. A method according to claim 32 wherein the hose end is suspended from surface buoys as it is drawn towards the target.

* * * * *